US008082666B2

(12) United States Patent
Baumgarten et al.

(10) Patent No.: US 8,082,666 B2
(45) Date of Patent: Dec. 27, 2011

(54) METHOD FOR PRODUCING AUTOMOTIVE PARTS

(75) Inventors: Jens Baumgarten, Frankfurt (DE); Oliver Lenhart, Frankfurt (DE); Peter Plapper, Rüsselsheim (DE)

(73) Assignee: GM Global Technology Operations LLC, Detroit, MI (US)

( * ) Notice: Subject to any disclaimer, the term of this patent is extended or adjusted under 35 U.S.C. 154(b) by 1143 days.

(21) Appl. No.: 11/573,605

(22) PCT Filed: Jul. 19, 2005

(86) PCT No.: PCT/EP2005/007842

§ 371 (c)(1),
(2), (4) Date: Feb. 12, 2007

(87) PCT Pub. No.: WO2006/018090

PCT Pub. Date: Feb. 23, 2006

(65) Prior Publication Data

US 2008/0201929 A1 Aug. 28, 2008

(30) Foreign Application Priority Data

Aug. 17, 2004 (DE) ..... 10 2004 039 882

(51) Int. Cl.
*B21D 53/88* (2006.01)

(52) U.S. Cl. ..... 29/897.2; 29/897; 29/428; 703/6; 703/7; 703/8

(58) Field of Classification Search ..... 29/897, 29/897.2, 428; 703/6–8
See application file for complete search history.

(56) References Cited

U.S. PATENT DOCUMENTS

| | | | | |
|---|---|---|---|---|
| 5,594,651 | A | 1/1997 | St. Ville | |
| 6,478,915 | B1 | 11/2002 | Schmalbruch et al. | |
| 7,137,201 | B2 * | 11/2006 | Brodt et al. | 29/897.2 |
| 7,194,388 | B2 | 3/2007 | Chu et al. | |
| 7,444,748 | B2 * | 11/2008 | MacNeil | 29/897.2 |

(Continued)

FOREIGN PATENT DOCUMENTS

DE 4420085 1/1996

(Continued)

OTHER PUBLICATIONS

Livatyali, H., et al., "Eperimental Investigation on Forming Defects in Flat Surface-Convex Edge Hemming: Roll, Recoil and Warp," Journal of Materials Processing Technology, Elsevier, Amsterdam, NL, vol. 153-154, Nov. 10, 2004, pp. 913-919.

(Continued)

*Primary Examiner* — Rich K Chang
(74) *Attorney, Agent, or Firm* — Ingrassia Fisher & Lorenz, P.C.

(57) ABSTRACT

The invention relates to a method for producing a bodywork component of a motor vehicle that has first been shaped and is then thermally surface-treated, said method comprising iterative simulated steps with variable geometric data of tools that are used in the shaping process. According to the invention, a continuous check verifies whether the expected geometric data of the component lies within the permitted tolerance range of the nominal geometric data of the component. If this is not the case, the geometric data and the generation of corrected tool geometric data is modified. This takes place in two stages, the first stage for the shaping steps and the subsequent stage for the process steps of the thermal surface treatment.

7 Claims, 2 Drawing Sheets

U.S. PATENT DOCUMENTS

| | | | | |
|---|---|---|---|---|
| 7,475,478 | B2 * | 1/2009 | McCrink et al. | 29/897.2 |
| 7,509,740 | B2 * | 3/2009 | Munk et al. | 29/897.2 |

FOREIGN PATENT DOCUMENTS

| | | | |
|---|---|---|---|
| EP | 1041130 | | 10/2000 |
| JP | 1044581 | A | 2/1989 |
| JP | 2003067445 | A | 3/2003 |
| JP | 2004001080 | A | 1/2004 |

OTHER PUBLICATIONS

Zhang, Guohua et al., "A Study on Fundamental Mechanisms of Warp and Recoil in Hemming," Journal of Engineering Materials and Technology, vol. 123, Oct. 2001, pp. 436-441.

Zhang, Guohua et al., "An Experimental Investigation of Curved Surface-Straight Edge Hemming," Journal of Manufacturing Processes, vol. 2, No. 4, 2000, pp. 241-246.

ISA, International Search Report for PCT Application No. PCT/EP2005/007842, Oct. 10, 2005.

ISA, International Preliminary Report on Patentability and Written Opinion for PCT Application No. PCT/EP2005/007842, Feb. 20, 2007.

Japan Patent Office, Japanese Office Action for Japan Application No. 2007-526326, Jun. 4, 2010.

China Patent Office, Chinese Office Action for Chinese Application No. 20058035037.

China Patent Office, Chinese Rejection Decision for Chinese Application No. 20058035037.

Daozhong Hu, et al. "Simulation Technology Of The Sheet Forming For Automotive Panel And Its Application On The Development Of Body Die," Die & Mould Manufacture, 1st period, pp. 11-14, Aug. 8, 2003.

* cited by examiner

METHOD FOR PRODUCING AUTOMOTIVE PARTS

CROSS-REFERENCE TO RELATED APPLICATIONS

This application is a U.S. National-Stage entry under 35 U.S.C. §317 based on International Application No. PCT/EP2005/007842, filed Jul. 19, 2005, which was published under PCT Article 21(2) and which claims priority to German Application No. DE 10 2004 039 882.8, filed Aug. 17, 2004.

BACKGROUND

In the background art methods of manufacturing attachment parts for automobiles are known, whereby from metal structural elements such as sheet-metal panel sections or the like a bodywork component of a motor vehicle is manufactured using forming steps. Afterwards, the component is often surface-treated under the effect of heat.

EP 1 041 130 A2 discloses edge flange sealing of bodywork components of motor vehicles, such as e.g. doors, tailgates, bonnets or sliding roof covers. The method used for this purpose is based on a pre-cross-linking of the sealing compound in the bodywork carcass by means of UV exposure. In a second step following immediately afterwards, the edge flange adhesive and the sealing compound are cured by the effect of heat. The bodywork components are then subjected to hot curing in a cataphoretic dip painting (CDP) oven.

Closer examination of the geometry of the attachment automobile part thus manufactured in the individual manufacturing stages reveals that the shape of the part alters considerably.

Thus, it is known that, because of the spring and/or elastic properties of the metal sheet used, during the forming steps there arise effects that are complicated to predict, particularly during flanging, pre-hemming and final hemming. Zhang, G., Hao, H., Wu, X., Hu, S. J., Harper, K., and Faitel, W., 2000, in "An experimental investigation of curved surface-straight edge hemming", J. of Manufacturing Processes, Vol. 2 No. 4, p. 241-246 as well as Zhang, G., Wu, X. and Hu, S. J., 2001 in "A study on fundamental mechanisms of warp and recoil in hemming", J. of Engineering Materials and Technology, Vol. 123, No. 4, p. 436-441, have conducted more thorough investigations in this respect.

Accordingly, attachment bodywork components and above all bonnets after pre-hemming and final hemming on flanging tools with a nominal geometry of the effective tool surfaces, i.e. the geometry of the tools used for this purpose corresponds to the nominal geometry of the component to be hemmed, present deviations from their nominal geometry. This is due above all to the phenomena "roll-in, roll-out, warp, recoil".

Also, after passing through cataphoretic dip painting and after subsequent oven drying, the components again present considerable deviations from their nominal geometry. There are several possible causes of these deviations. For instance, during the non-cutting manufacture (drawing, trimming, flanging, hammering, hemming) internal stresses introduced into the bonnets are reduced. Added to this is the fact that any edge-flange and lining adhesives that are used present a different thermal expansion behavior from the metal components, which are often made of steel. Finally, curing of the adhesives gives rise to a "freezing" of the thermal-expansion-related deviation of the geometry of the bonnet at the end of the CDP cycle. The dimensional deviations arising in the course of cataphoretic dip painting and subsequent oven drying are compensated, if possible, by time-consuming and costly product- and/or process modifications as well as by optionally necessary manual straightening.

SUMMARY

The object of the invention is to provide a method whereby the problems of the background art are avoided.

This object is achieved by the subject matter of the independent claims. Advantageous developments arise from the dependent claims.

According to the invention, firstly tool geometry data of tools to be used for the forming operation, nominal geometry data of the component as well as permissible tolerances of said nominal geometry data of the component are defined. Then the process steps of the forming operation using the tool geometry data are simulated and the geometry data of the component that are accordingly to be expected are calculated.

If the result of a subsequent check is that the geometry data of the component that are to be expected do not lie within the permissible tolerance range of the nominal geometry data of the component, then the tool geometry data are modified to corrected tool geometry data until a subsequent repeat execution of the preceding steps reveals that the geometry data of the component that are to be expected lie within the permissible tolerance range of the nominal geometry data of the component.

According to the invention, it is only after this that the process steps of the surface treatment under the effect of heat are simulated, wherein in this case the geometry data of the component that are accordingly to be expected are determined. In this case, "surface treatment under the effect of heat" may mean any possible further treatment, during which heat arises or is supplied, i.e. for example also an edge flange sealing of bodywork components of motor vehicles, such as for example doors, tailgates, bonnets or sliding roof covers, as shown in EP 1 041 130 A2. The pre-cross-linking of the sealing compound by UV exposure that is used there and the subsequent thermal action upon the edge flange adhesive and the sealing compound for the purpose of curing namely also lead likewise to distortions and elongations, which according to the invention are not to be taken into account until the second iteration step. This applies in particular to the subsequent hot curing of the bodywork components in a CDP oven. This splitting of the optimization according to the invention into two or more iteration steps has proved very successful. This is due to the fact that the errors to be expected from the forming of the component are of a different nature to those from the subsequent heat treatment thereof. The errors to be expected from the forming of the component are accordingly taken into account in the first iteration step. All further iteration steps then relate to subsequent treatments of the component that no longer involve forming operations.

If it is then established that the geometry data of the component that are to be expected do NOT lie within the permissible tolerance range of the nominal geometry data of the component, the nominal geometry data of the component are modified, corrected geometry data of the component are produced and then the above steps are repeated, wherein however the corrected geometry data of the component are used instead of the nominal geometry data of the component.

In summary, it may be said that here a two-stage iteration occurs, which leads very quickly to good results.

It is only after this that production and/or mass production of the component begins using the corrected geometry data of the component as well as the corrected tool geometry data.

According to the invention, validation operations may also be provided in the form of single-piece production of the component using the nominal geometry data and/or optionally the corrected geometry data of the component as well as using the tool geometry data and/or optionally the corrected tool geometry data. In this case, it is checked whether the real geometry data of the component match the calculated geometry data. From this, conclusions may be drawn about the quality of the simulation methods used.

The invention avoids the reduction or minimizing of deviations of the geometry of the bodywork components from the nominal geometry by laborious manual adjustments of the flanging tools in that the geometry of the effective surfaces of the tools is corrected. Such a correction may often be effected only intuitively, iteratively and on the basis of the expertise of the adjuster and is often not documented, which is particularly disadvantageous.

Rather, the invention provides a simulation-assisted method of reducing the necessary flanging operations for the production of attachment automobile parts such as bonnets, tailgates and doors, which may be used to particular advantage when flanging operations followed by a cataphoretic dip painting (CDP) cycle are provided. It has namely emerged that in this case dimensional deviations occur particularly frequently. The method according to the invention is however also applicable to all other manufacturing methods, in which forming processes followed by heat treatments, say for painting operations or the like, are provided.

With the invention, the dimensional deviations of attachment bodywork parts that result from the flanging operations and the CDP cycle are proactively determined and then reduced using a computer- and/or simulation-assisted method. In so doing, the entire forming- and joining history of the attachment bodywork part is taken into account.

The invention provides a simulation-assisted method of reducing the dimensional deviations, which result from the flanging operations (pre- and final hemming) and the subsequent cataphoretic dip painting (CDP) cycle that are necessary for the production of attachment automobile parts (bonnets, tailgates, doors).

The method according to the invention is a sequence of simulations, comparisons of data sets and geometry manipulations. To reduce the user effort, the method is to be automated by the use of so-called shell scripts. The necessary comparisons of data sets and the geometry manipulations are advantageously to be realized in a higher-level language. The user prompting is to be realized via a GUI or graphical user interface.

The main field of application of the method is the "front-loading" situation described here, in which the method is used already before tool making to determine the optimum workpiece geometry as well as the optimum effective tool surface geometries. The method is however likewise usable to assist the adjustment process of already existing flanging tools. In this situation, the effective surfaces of the tools are to be acquired by means of an optical measuring technique and used instead of the nominal data as input data for the simulations in method step 1.

Use of the invention offers numerous advantages, namely a reduction of the work involved in adjusting the flanging tools, because effective tool surfaces may be produced in accordance with the optimum data. Ideally, such adjustments of the flanging tools are no longer needed. This leads to direct cost savings in the form of "man hours", a more reliable start of a series and a steeper start curve.

The designing of the flanging tools is effected no longer intuitively based on experience but based on knowledge. The knowledge used for this purpose is stored in the method and is available at all times. There is no longer a reliance on expertise that is often, possibly at critical moments, not available as a result of sickness, holiday leave etc.

The work involved in product- and/or process modifications and in an optionally necessary straightening of the attachment parts after the CDP cycle and oven drying is crucially reduced and/or even entirely eliminated.

Rejects because of attachment parts that can no longer be straightened when the deviation from nominal geometry is too great are avoided. This leads to direct cost savings in the form of "man hours", a more reliable start of series and a steeper start curve.

BRIEF DESCRIPTION OF THE DRAWINGS

The present invention will hereinafter be described in conjunction with the following drawing figure, wherein like numerals denote like elements.

DETAILED DESCRIPTION

The following detailed description of the invention is merely exemplary in nature and is not intended to limit the invention or the application and uses of the invention. Furthermore, there is no intention to be bound by any theory presented in the preceding background of the invention or the following detailed description of the invention.

Figure 1A:
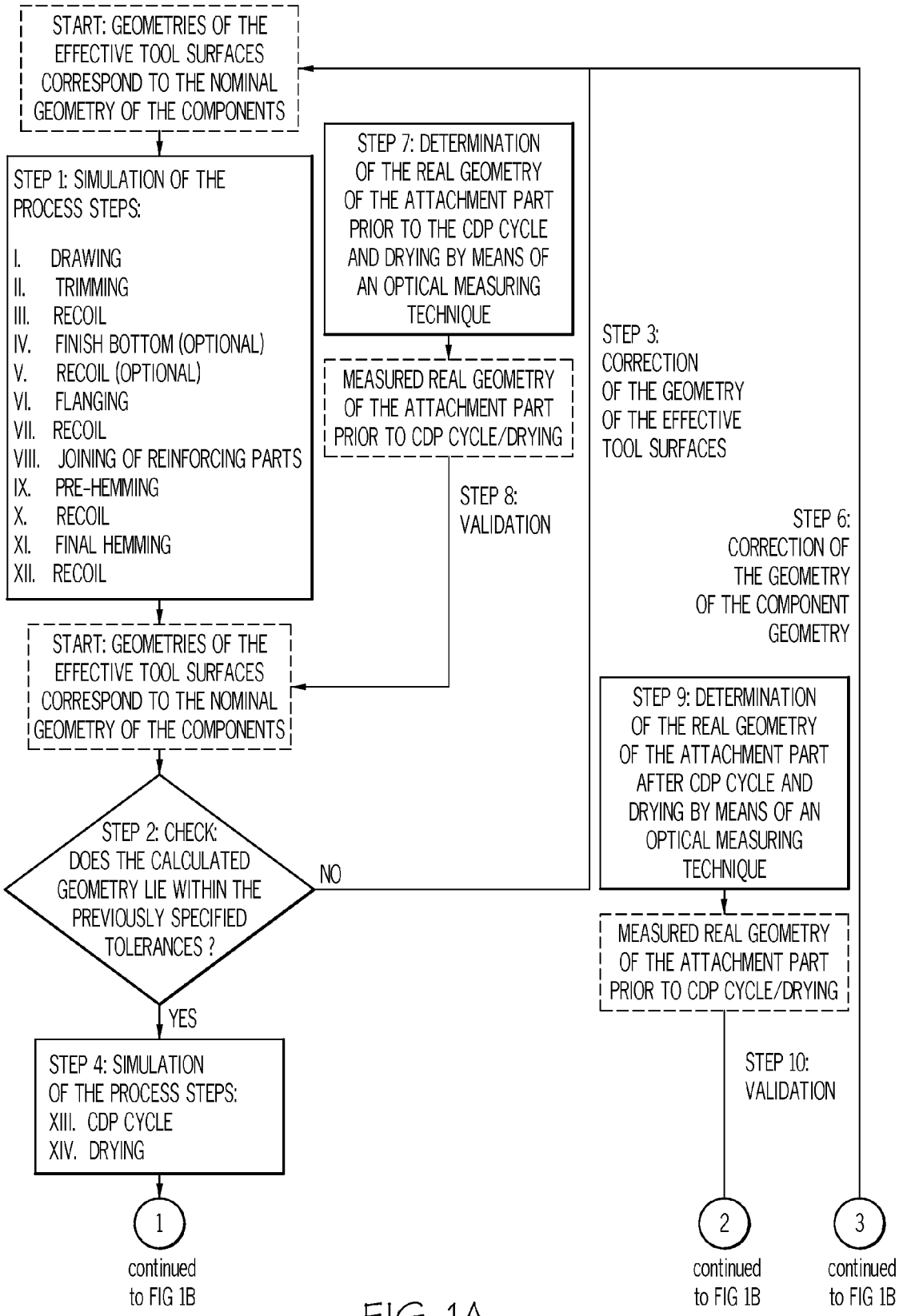
FIGS. 1A and 1B show the individual steps of the method in the form of a program flowchart.
Figure 1B:
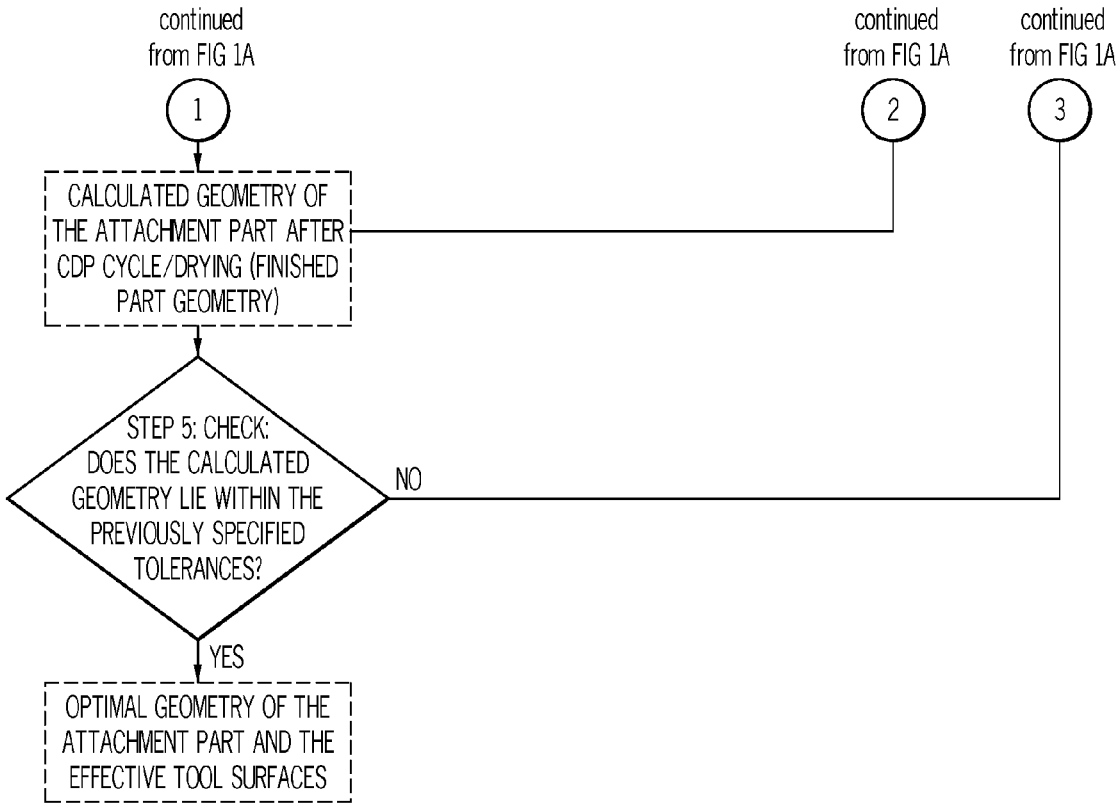

Here, the Arabic numerals "1" to "10" indicated in FIG. 1 correspond to the following steps "step 1" to "step 10" where this is not expressly indicated.

In "step 1" there occurs a simulation of the process steps such as drawing, trimming, hammering (depending on the individual part), flanging, joining of the reinforcing parts for the respective individual part that goes into the attachment part. In the case of a bonnet, these are the skin of the bonnet and the frame of the bonnet. The joining of the individual parts by pre-hemming and final hemming is also one of the process steps that are to be simulated here. After the process steps: trimming, hammering, flanging, pre-hemming and final hemming, in each case the recoil arising in reality is likewise to be simulated. The simulation may be effected by a commercially obtainable finite element simulation system. The employed geometries of the effective tool surfaces correspond during the first execution of the method to the respective nominal geometries of the individual parts to be produced. The result of this simulation is the geometry of the attachment part that is achievable with the employed effective surface geometries of the tools. Where possible, during the simulation of the individual process steps the elongation-, strain- and sheet thickness distributions resulting from the in each case preceding process step are also to be taken into account.

In "step 2" there is a check whether the geometry of the attachment part calculated in "step 1" lies within the previously specified tolerances. The check is effected on the basis of a point-by-point comparison of the calculated geometry and the nominal geometry, which exists in the form of the CAD data from designing the attachment part. If the calculated geometry lies within the tolerances, the method immediately continues with "step 4". If the geometry does not lie within the tolerances, in "step 3" a suitable correction of the effective tool surfaces as well as a repeat execution of "step 1" occurs. Steps 1 to 3 are repeated until the calculated geometry of the produced attachment part lies within the tolerances.

In "step 3" the correction of the effective tool surfaces already mentioned above occurs. The correction is based on the deviations of the calculated geometry of the attachment part from the nominal geometry thereof that were previously determined point by point. The correction is effected by means of a point-by-point translation of the geometry of the effective tool surfaces along previously determined vectors. The determination of the translation vectors is effected with the aid of suitable algorithms. In "step 3", preferably the effective surface geometry of the pre-hemming tools is corrected because, according to the findings underlying the invention, these have a very great influence upon the geometry of the attachment part.

In "step 4" a simulation of the CDP cycle and the subsequent oven drying is effected. For this purpose, the simulation model forming the basis of "step 1" is to be supplemented by a suitable modelling of the edge flange and lining adhesives. The temperature dependence of the mechanical properties of the adhesives is to be mapped using a suitable material law.

In "step 5" there is a check whether the geometry of the attachment part calculated in "step 4" lies within the previously specified tolerances. The check is effected on the basis of a point-by-point comparison of the calculated geometry and the nominal geometry, which exists in the form of the CAD data of the attachment part. If the calculated geometry lies within the tolerances, the method is terminated; the optimum geometry of the effective tool surfaces and of the attachment part are therefore determined. If the geometry does not lie within the tolerances, in "step 6" a suitable correction of the component geometry and a repeat execution of steps 1 to 4 occurs. Steps 1 to 6 are repeated until the calculated geometry of the attachment part lies within the permissible tolerances.

In "step 6" a correction of the geometry of the attachment part is effected. The correction is based on the deviations of the calculated geometry of the attachment part from the nominal geometry thereof that were previously determined point by point. The correction is effected by means of a point-by-point translation of the nominal geometry along previously determined vectors. The result is an auxiliary geometry. In this case, the correction is effected in that the auxiliary geometry of the attachment part during the CDP cycle and the subsequent drying is so deformed that the resulting dimensional and shape deviations of the painted finished part from the nominal geometry are minimized. The determination of the translation vectors is effected with the aid of suitable algorithms.

In "step 7" the real geometry of the attachment part prior to the CDP cycle and drying is determined by means of an optical measuring technique.

In "step 8" the simulation results from "step 1" are validated by means of a point-by-point comparison of the calculated geometry with the real geometry determined in "step 7".

In "step 9" the real geometry of the attachment part after the CDP cycle and drying is determined by means of an optical measuring technique.

According to "step 10", the simulation results from "step 4" are validated by means of a point-by-point comparison of the calculated geometry with the real geometry determined in "step 8".

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

The invention claimed is:

1. A method of manufacturing a bodywork component of a motor vehicle that is first formed with a forming operation and then surface-treated under an effect of heat with a surface treatment, wherein the bodywork component comprises at least one metal structural element and wherein the method comprises the steps of:

a) providing tool geometry data of tools to be used for the forming operation, nominal geometry data of the bodywork component as well as permissible tolerances of said nominal geometry data of the bodywork component;

b) simulating process steps of the forming operation using the tool geometry data as well as calculating the geometry data of the bodywork component that are accordingly to be expected;

c) checking whether the geometry data of the bodywork component that are to be expected lie within the permissible tolerances of the nominal geometry data of the bodywork component;

d) provided that in step c) it has been established that the geometry data of the bodywork component that are to be expected do not lie within the permissible tolerances of the nominal geometry data of the bodywork component;

e) modifying the tool geometry data and producing corrected tool geometry data and then repeat execution of steps b) and c) using the corrected tool geometry data;

f) simulating process steps of the surface treatment under the effect of heat as well as calculating the geometry data of the bodywork component that are accordingly to be expected;

g) checking whether the geometry data of the bodywork component that are to be expected lie within the permissible tolerances of the nominal geometry data of the bodywork component;

h) provided that it is established in step g) that the geometry data of the bodywork component that are to be expected do NOT lie within the permissible tolerances of the nominal geometry data of the bodywork component;

i) modifying the nominal geometry data of the bodywork component and producing corrected geometry data of the bodywork component and subsequent repeat execution of steps b) to g) using the corrected geometry data of the bodywork component instead of the nominal geometry data of the bodywork component; and j) starting production of the bodywork component using the corrected geometry data of the bodywork component as well as the corrected tool geometry data.

2. The method according to claim 1, characterized in that after step b) and before step d) a first validation operation is provided in a form of a single-piece production of the bodywork component using the nominal geometry data or if appropriate the corrected geometry data of the bodywork component as well as using the tool geometry data or if appropriate the corrected tool geometry data.

3. The method according to claim 2, characterized in that after step g) and before step j) a second validation operation is provided in the form of the single-piece production of the bodywork component using the nominal geometry data or if appropriate the corrected geometry data of the bodywork component as well as using the tool geometry data or if appropriate the corrected tool geometry data.

4. The method according to claim 2, characterized in that the process steps of the forming operation includes one or more machining techniques selected from a group consisting of drawing, hammering, flanging, joining, pre-hemming, and final hemming.

5. The method according to claim 4, characterized in that during simulation of individual process steps of the forming operation, elongation-, strain- and sheet thickness distributions resulting from a respective preceding process step are taken into account.

6. The method according to claim 1, characterized in that the process steps of the surface treatment under the effect of heat includes one or machining techniques selected from a group consisting of: edge flange sealing with pre-cross-linking, curing of a sealing compound, curing of an edge flange adhesive, cataphoretic dip painting, and oven drying.

7. The method according to claim 1, characterized in that, instead of the nominal geometry data of the bodywork component, data of an auxiliary geometry of the bodywork component are provided, namely in that the auxiliary geometry of the bodywork component during thermal loading is so deformed that a resulting dimensional and shape deviations of a finished component from the nominal geometry data are reduced.

* * * * *